US005320889A

United States Patent [19]

Bettle, III

[11] Patent Number: 5,320,889

[45] **Date of Patent: * Jun. 14, 1994**

[54] PLASTIC BOTTLE FOR FOOD

[75] Inventor: Griscom Bettle, III, Sarasota, Fla.

[73] Assignee: Tropicana Products, Inc., Bradenton, Fla.

[ * ] Notice: The portion of the term of this patent subsequent to Oct. 21, 2008 has been disclaimed.

[21] Appl. No.: 781,009

[22] Filed: Oct. 21, 1991

Related U.S. Application Data

[63] Continuation of Ser. No. 297,593, Jan. 17, 1989, abandoned.

[51] Int. Cl.[5] ..... B65D 1/00

[52] U.S. Cl. ..... 428/36.6; 428/516; 428/518; 428/520; 426/127; 215/12.2

[58] Field of Search ..... 428/35.9, 35.7, 349, 428/351, 343, 542.8, 515, 516, 520, 36.6, 518; 426/127; 229/3.1; 215/1 C, 12.2

[56] References Cited

U.S. PATENT DOCUMENTS

| | | | |
|---|---|---|---|
| 3,932,692 | 1/1976 | Hirata | 428/520 |
| 4,511,610 | 4/1985 | Yazaki | 215/1 C |
| 4,701,360 | 10/1987 | Gibbons | 229/3.1 |
| 4,705,708 | 11/1987 | Briggs | 426/127 |
| 4,846,359 | 7/1989 | Baird | 215/1 C |
| 4,877,682 | 10/1989 | Sauers | 428/515 |
| 4,977,004 | 12/1990 | Bettle | 426/36.7 |
| 4,990,382 | 2/1991 | Weissenstein | 428/36.7 |

*Primary Examiner*—Ellis P. Robinson
*Assistant Examiner*—Rena L. Dye
*Attorney, Agent, or Firm*—Cook, Egan, McFarron, & Manzo, Ltd.

[57] ABSTRACT

A multi-layer, coextruded blow-molded plastic bottle consists of a layer of EVOH sufficiently thick to inhibit moisture from inside the bottle from penetrating from the interior surface of the EVOH layer to the exterior portion of the EVOH layer, and a second layer positioned exterior to the EVOH layer, wherein the second layer prevents moisture outside the bottle from reaching the EVOH layer, whereby the interior surface of the EVOH layer functions as an oil barrier and the exterior portion of the EVOH layer function as a oxygen barrier.

3 Claims, 1 Drawing Sheet

PLASTIC BOTTLE FOR FOOD

This is a continuation of copending application Ser. No. 07/297,593, filed on Jan. 17, 1989, now abandoned.

The present invention relates to a blow molded plastic bottle for food which provides reduced oxygen migration into the bottled food and reduced flavor loss from the bottled food, and thus provides a bottle which provides excellent flavor preservation and extended shelf life for bottled food products. The bottle of the present invention is particularly useful in packaging orange juice.

DESCRIPTION OF THE PRIOR ART

Glass provides a technically superior packaging material for food products, because it is impervious to oxygen migration from air through the container into the packaged food and is impervious to the migration of flavor components out of the packaged food product into the container. However, glass is subject to breakage. When the glass is made thick enough to resist breakage, the resulting package is relatively heavy and consequently it is expensive to ship.

Various paper structures and plastic bottles have been used as a replacement for glass as a packaging material. Plastic bottles, chiefly produced from polyethylene, have been widely used because they are light in weight, readily fabricated, and inexpensive. Moreover, they can be disposed of through incineration and the like.

Although polyethylene bottles have relatively good shape retaining properties and can be made relatively economically such bottles, like all polyethylene products, allow oxygen and other gases to pass into the bottle and out of the bottle. One result is that polyethylene bottles are not effective for packaging carbonated beverages. As another result, products which are packaged in polyethylene bottles may be oxidized. This problem is common to other plastics as well, including polyethylene terephthalate (PET) and others. Many food products, such as orange juice, include components which are subject to rapid oxidation, such as ascorbic acid and many of the key flavor molecules. Consequently, orange juice stored in polyethylene bottles or PET bottles, even if refrigerated, is subjected to oxygen degradation of both vitamin content and flavor content.

Moreover, polyethylene has a tendency to absorb certain oils, i.e., certain oils are soluble in the polyethylene. Flavor "scalping" occurs when orange oil in orange juice is absorbed into the polyethylene layer. The orange oil which is absorbed carries with it certain oil-soluble flavor components from the orange juice. Other flavor components are not absorbed by the polyethylene layer and remain in the orange juice. As a result, the orange juice in a conventional package develops an unbalanced, "off" flavor which cannot be restored to the "as made" flavor merely by the addition of more orange oil to the packaged juice.

The prior art workers are aware of the tendency of polyethylene to allow oxygen or other gases to pass through the polyethylene. Prior art workers have proposed multi-layer packaging materials which include, in addition to the polyethylene, an oxygen barrier of another gas-impermeable plastic. The prior art has also suggested that multi-layer structures may be fabricated, wherein ethylene vinyl-alcohol co-polymers (EVOH) is sandwiched between the other plastic layers, whereby the EVOH layer serves as the oxygen barrier. Packages containing oxygen barriers are suggested in U.S. Pat. Nos. 3,620,435; 4,261,473; 4,393,106; 4,421,823; 4,486,378; 4,526,823; 4,534,930; 4,551,366; 4,557,780; 4,608,286; 4,646,925 and 4,649,004.

Further, the prior art has suggested that coextrusion techniques may be used to form multi-layer parisons, which can be fabricated into bottles by blow-molding techniques, wherein EVOH is positioned as an intermediate layer in order to serve as a gas barrier. See, for example, U.S. Pat. Nos. 4,079,850, 4,741,936 and 4,743,479.

The prior art, for the most part, has not dealt with the problem caused by the tendency of certain plastics, such as polyethylene, to absorb oil from packaged products and the resulting flavor scalping problem with orange juice. None of the prior art has described plastic bottles, wherein the multi-layer bottle is coextruded and then blow-molded to provide a structure having an oil barrier on the innermost layer of the bottle. Accordingly, the prior art structures have suffered, to some extent, from their tendency to absorb oils from the packaged products into the packaging, per se.

Co-pending application Ser. No. 101,730 filed Sep. 28, 1987 describes and claims a blow-molded plastic bottle of 7 layers which includes an interior layer of EVOH, in contact with the packaged product. The second layer of EVOH is a so-called "buried" layer, which is sandwiched between 2 moisture barriers in order to enhance the oxygen barrier characteristics of the EVOH. This bottle has been successful in overcoming both oxygen deterioration and oil loss from a packaged food, but the structure is relatively expensive to manufacture.

SUMMARY OF THE INVENTION

The present invention provides a multi-layer structure adapted to be coextrusion blow-molded into bottles which are economical food containers, which provide protection against oxidation of the packaged food and which provide protection against loss of flavor (i.e., scalping) from the food into the package. The bottles of the present invention may be fabricated using commercially available coextrusion blow-molding techniques.

In its broadest embodiment, the present invention comprises a multi-layer plastic bottle having as its interior surface one relatively thick layer of ethylene-vinyl alcohol copolymer (EVOH) in contact with the packaged product (i.e., the interior layer). The other layer or layers, i.e., outer layers, provide an outside moisture barrier and also provide structural support for the bottle.

In the preferred embodiment of the present invention, the bottle wall comprises four layers, which are (starting from the exterior surface) as follows:

High-density polyethylene (HDPE);

Regrind (reground scrap from the blow-molding process);

Adhesive;

Ethylene-vinyl alcohol copolymer (EVOH).

PLASTIC BOTTLES

Figure 1:
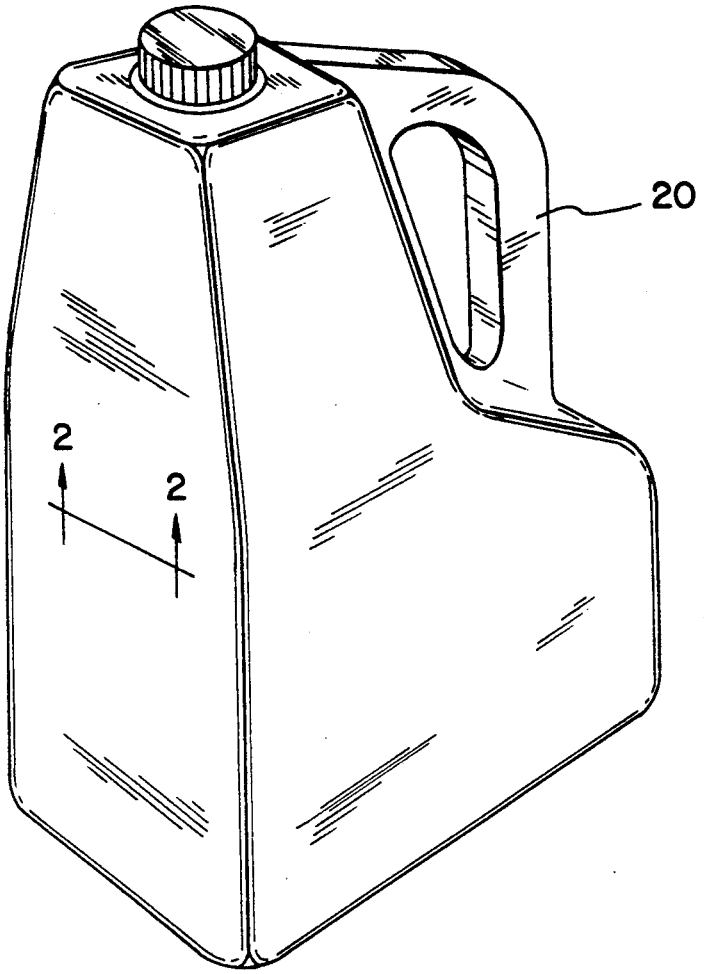
FIG. 1 is a perspective view of a plastic bottle of the present invention.
Figure 2:
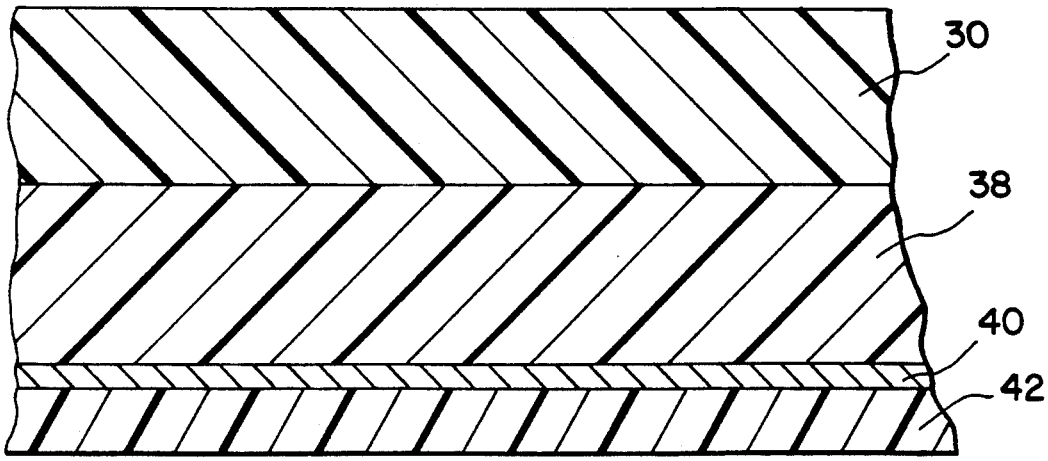
FIG. 2 is a cross-section of the bottle wall, taken at 2—2 of FIG. 1, of a blow-molded plastic bottle showing the barrier structure of the present invention.

The bottle of the present invention is a multi-layer, coextrusion blow-molded formed plastic bottle, illustrated by FIGS. 1 and 2. The present invention is not limited to the particular bottle shape illustrated in FIG. 1. In the preferred embodiment, shown by FIG. 2, the bottle comprises a multi-layer structure, wherein exterior layer 30 made up of high density polyethylene, which is joined to an intermediate layer of regrind 38, which in turn is joined by adhesive layer 40 to the interior layer of EVOH 42.

The blow-molded bottle of the present invention, generally speaking, must be at least 10 mils thick at its thinnest point in order to provide sufficient strength and rigidity (ie., "structure") to allow handling. In the areas around the handle 20, it is preferred that the thickness of the bottle be greater because the bottle is handled using the handle area and subject to more stress than the body of the bottle. Ideally, the balance of the bottle should be as thin as possible, in order to use the least amount of material and thus reduce the cost of the bottle. Bottles wherein the thinnest portion of the bottle are about 15 mils thick have been found useful.

Bottles of the type shown in FIGS. 1 and 2 may be fabricated by coextrusion blow-molding techniques. Preferably, the bottle of the present invention will have the following layers and dimensions:

| | |
|---|---|
| High Density Polyethylene | 5 mils; |
| Reground High Density Polyethylene | 4.4 mils; |
| Plexar Adhesive | .1 mil; and |
| EVOH | .5 mils. |

The exterior layer of high density polyethylene provides strength and functions as the main structure providing layer of the plastic bottle. The exterior layer of the bottle is preferably about 5 mils of high density polyethylene. Regrind layer 38 is interposed between the adhesive layer and the HDPE layer and serves as a moisture barrier for the dry side of the EVOH. Regrind 38 is advantageously a mixture of scrap reground high-density polyethylene/adhesive/EVOH from the blow-molding process. The regrind layer is preferably about 4 to 5 mils in thickness and provides physical strength to the bottle. Adhesive layer 40 preferably bonds the regrind to the EVOH. Adhesive 40 may be selected from a wide variety of blow-molding adhesives which are conventionally used to join HDPE and EVOH materials during coextrusion processes. Good results have been obtained using a polyolefin based thermoplastic adhesive sold under the tradename Bynel CXAE-207 by DuPont. The Plexar adhesives are also suitable for adhesives for use in preparing coextruded, blow-molded bottles. The interior layer of EVOH provides both an oil barrier (scalping barrier) and an oxygen barrier.

It is essential that the EVOH layer be at least 0.5 mils thick at the thinnest point of the bottle, although EVOH layers from about 1.5 to 2.0 mils thick are useful. As a practical matter, the EVOH layer may be much thicker, particularly for bottles wherein food products are to be held under non-refrigerated conditions. Commercially useful bottles, wherein the EVOH layer is from 1 to 1.5 mils thick have been successfully used to package orange juice which is stored at 35°–40° F. It is also necessary that the EVOH contain at least 32 mol percent of ethylene.

DETAILED DESCRIPTION OF THE INVENTION

The plastic bottle of the present invention preferably comprises four layers of coextrudible plastic. As shown in FIG. 2, the bottle has an exterior layer 30 of high density polyethylene, an intermediate layer of regrind 38, an adhesive or tie layer 40 and an interior layer of 0.5 mil layer of EVOH.

Function of the Layers

The blow-molded bottle of the present invention has as its interior layer a relatively thick layer of an ethylene-vinyl alcohol copolymer (sometimes referred to as EVOH), which is positioned to contact the packaged food. Thus, one surface of the EVOH layer will be in contact with the food (hereinafter called the "wet side") and the other surface of the EVOH layer (i.e., the "dry" side) will be separated from the food by the thickness of the EVOH layer. The EVOH interior layer serves as an oil barrier to prevent the absorption of oil and oil-soluble flavors from the packaged food into the bottle.

It is known that a dry layer of EVOH, i.e., a layer of EVOH which is insulated on both sides from moisture, provides a superior oxygen barrier, i.e., oxygen impermeability. To achieve the best oxygen barrier, it is important that the EVOH layer be bone dry and insulated from any moisture coming from inside or outside of the package. It is also known that high density polyethylene and/or the regrind (polyethylene/adhesive/EVOH) and/or the adhesive (which make up the exterior layers of the bottle of the present invention) function as a moisture barrier which may be used to keep EVOH dry. In the preferred embodiment of the present invention, the high density polyethylene and the regrind and the adhesive layers serve as exterior moisture barriers to prevent moisture from outside the bottle from contacting the EVOH layer.

It has been discovered that the portion of a EVOH layer which is adjacent to the "wet side" (hereinafter the "wet portion") will function as a moisture barrier to protect the dry portion (the portion adjacent to the dry side) of the EVOH layer from moisture within the package, provided the EVOH layer is thick enough. The wet portion of the EVOH layer, which is in contact with the food, functions as a sacrificial layer insofar as it does not contribute as significantly to the oxygen impermeability. The wet portion of the EVOH layer functions as a moisture barrier, thus preventing moisture from the packaged food from reaching the "dry portion" of the EVOH layer. When combined with the exterior moisture barrier, this allows the "dry portion" of the EVOH to function as a superior oxygen barrier.

Although the wet side of the EVOH will absorb a finite amount of moisture from the packaged food, EVOH does not absorb significant quantities of oil or oil-soluble flavor components from orange juice or other products, i.e., it does not scalp flavors. Because the EVOH does not absorb the oils from orange juice, the orange juice does not take on an unbalanced, "off" flavor, but retains all of the flavor components which are essential to maintain "fresh" juice flavor. The wet side of the EVOH layer thus also functions as an oil barrier, and the dry portion of the EVOH layer, protected from both interior moisture and exterior moisture, functions as an oxygen barrier, thus providing a package which has superior flavor and taste retention properties.

EVOH LAYER

The ethylene-vinyl alcohol copolymer used in the present invention is a copolymer obtained by converting a substantial percentage of the vinyl acetate units in an ethylene-vinyl acetate copolymer to vinyl alcohol units. Generally, such copolymers comprise 30 to 60 mol percent of ethylene and 40 to 70 mol percent of vinyl acetate, of which 90% or 95% are converted to vinyl alcohol units by saponification. The ethylene-vinyl alcohol copolymer used in the bottles of the present invention must have an ethylene content above 30 mol percent with a saponification degree of at least 90%, and preferably at least 95%. It is necessary to use EVOH containing from about 32 to about 44 mol percent ethylene. When the ethylene content less than 32%, problems are encountered sealing the bottle at those points where EVOH is required to self-seal, i.e., EVOH is adhered to EVOH, e.g., at the handle and at the bottom of the parison. When the ethylene content is more than about 50 mol percent, the oxygen permeability increases so that the favorable characteristics of the ethylene-vinyl alcohol copolymer are lost. When the conversion rate (equal to the saponification degree) of the vinyl acetate unit into the vinyl alcohol unit is less than 95%, the hygroscopic quality increases and the oxygen impermeability under high humidity is lower.

The EVOH typically has a molecular weight in the range of about 20,000–30,000 and a melting point temperature of about 160°–190° C. These characteristics correspond roughly to melt indices of about 9 to 1.5. and are determined in accordance with ASTM test D-1238, condition 190/2.16 or condition 210/2.16. It is important that the EVOH have a melt flow index of between about 2.9 and 3.5 as measured by ASTM test D-1238, condition 210/2.16. It is preferred that the melt flow index be about 3.2 on this basis. Typically the EVOH has a specific gravity of 1.1 to 1.2. Suitable temperature for processing EVOH is about 400°–460° F. and preferably 410°–440° F. While the degradation temperature of the EVOH is generally regarded to be about 460°, this is not inconsistent with the higher processing temperatures described herein due to the short residence time of the extrusion process.

Commercially available EVOH resins which have been used include SORANOL DC, from Nippon Goshei, which contains 32 mol percent of ethylene; EVAL F-101 from EVALCO, containing 32 mol percent of ethylene; and EVAL 153 from EVALCO containing 40 mol percent ethylene. These resins may be obtained at various melt flow indices in the required range given above. Illustrative of other EVOH resins that may be used are the EVAL resins available from Kuraray, including EP-E and EP-F, which contain about 44 mol percent and 32 mol percent ethylene, respectively, in the molecule and have melting point of 164° C. and 181° C., respectively. These resins are available with different melt indexes, i.e., EP-F101 has a melt index of 1.3, while EP-F104 has a melt index of 4.4., as measured by ASTM test D-1238, condition 190/2.16. Additional useable EVOH resins are available from DuPont, and SORANOL-E and SORANOL-ET available from Nippon Goshei, both of which contain 38 mol percent ethylene and exhibit flow melt values of 8.0 and 3.5, respectively, as measured by ASTM test D-1238, condition 210/2.16.

The ethylene-vinyl alcohol copolymer may also comprise as a co-monomer, other olefins such as propylene, butenel, pentene-1 or 4-methyl pentene-1 in such an amount as not changing the inherent properties of the copolymer, that is, in an amount of up to about 5 mol percent based on the total of copolymer.

In the present invention, ethylene-vinyl alcohol copolymers of the above mentioned type may be used singly or in the form of a mixture of two or more EVOH copolymers.

The present invention contemplates inclusion of a nylon (polyamid) in the EVOH to impart the property of toughness to the film, while reducing the amount of the more expensive EVOH which is used. Structural properties improve toughness of this layer are discernible with as little as 10% by weight of the nylon, based on weight of the total layer composition. Further, the ethylene-vinyl alcohol copolymer may be mixed with a polyamid in order to enhance the fabricating properties of the ethylene-vinyl alcohol copolymer. It is generally preferred to use a minor amount of the polyamid in the mixture.

If the EVOH is blended with a polyamid polymer, it is desirable to have more than 50% EVOH in the composition in order to impart the necessary oxygen barrier property generally associated with EVOH. Improved oxygen barrier properties are achieved as the EVOH percentage is increased up to 90%. Generally, blends of EVOH and polyamids are used. It is preferred that the blends comprise 70–90% EVOH.

Generally speaking, an EVOH layer having a minimum thickness of approximately 0.5 mils is adequate for bottles to hold orange juice under refrigerated conditions. The oxygen permeability of the EVOH is affected significantly by the temperature at which the food is stored, wherein oxygen permeability increases with increasing temperature. The EVOH layer of 0.5 mils described herein is suitable for bottles designed for storage of orange juice at temperatures no higher than about 45° F. For a package designed to store or contain orange juice at room temperature, it would be desirable to increase the thickness of the EVOH layer to 2 mils or more, although this adds to the cost of the package.

The solubility of the orange juice oils in the EVOH, however, is not dramatically affected by the temperature in packages designed to store foods of up to 12 weeks or so.

HDPE LAYER

The exterior layer of the bottle of the present invention is preferably a coextrudible high-density polyethylene (HDPE). The HDPE functions to give size, shape, and strength to the bottle. It also serves as the base for labels which may be applied by silk screening and the like. The thickness of the HDPE may vary over wide limits, depending upon the physical parameters desired for the bottle and based upon the quantity of "regrind" scrap which is available. Generally, it is preferred to have the HDPE layer from about 3 to 10 mils thick and preferably the HDPE layer is about 5 mils thick.

The HDPE used in the present invention may be any high-density polyethylene prepared by any one of the commercial low-pressure methods. Copolymers of ethylene with a small amount of other mono-olefin series monomers, i.e., propylene, etc., may be used but the melt index of the resulting polymer must be in the range of from 0.1 to 1.0.

REGRIND

The "regrind" used as the second layer in the 4 layer bottle of the present invention comprises scrap from the extrusion blow-molding operation which is reground and used as an intermediate layer in the bottle. Scrap from the extrusion molding of bottles of the present invention include principally high-density polyethylene, and a small amount of EVOH (approximate ratio about 10 to 1 by weight), along with a small amount of adhesive. The presence of the 10% of EVOH intermixed with the HDPE scrap is advantageous in that it improves the bondability or adhesion of the regrind to both the HDPE and to the adhesive layer.

The thickness of the regrind layer may be varied somewhat depending upon the amount of scrap available, but generally it is preferred to have the thickness of the regrind layer between 50% and 80% of the HDPE. Accordingly, it is preferred that the regrind be from 0 mils to 7 mils thick with about 4.5 mils being preferred.

In the present invention the HDPE and the regrind function as a moisture barrier which prevents moisture from outside the package from seeping into the package and keeps the dry side of the EVOH layer dry. Moreover, the regrind layer provides strength and structural rigidity to the resulting bottle. Further, the use of regrind provides a bottle which is significantly more economical to produce than one produced from virgin HDPE.

ADHESIVE LAYER

The adhesive layer must be a coextrudible adhesive. The thickness of the adhesive is not critical to the oxygen barrier or flavor preservation as long as the dry side of the EVOH layer is kept dry, but adhesive thickness may impact upon the structural aspects of the package. Such adhesive layers may be 0.5 mils in thickness, by way of example. A variety of adhesives may be used. Adhesives designed to adhere the EVOH layer to the regrind may comprise a low-density polyethylene, which is chemically modified, to insert functional groups on the polymer chains which bond to polar substrates, such as EVOH. The adhesive layer may comprise a modified ethylene-vinyl acetate copolymer having a vinyl acetate content of from about 20% to about 40% modified with up to about 2% by weight of maleic anhydride and having a melt index of 1.5 to 2 grams as measured by ASTM test D-1238, condition 190/2.16. A suitable family of adhesives, which are chemically modified polymeric resins, is available under the name Plexar from USI Chemicals Co. Division of National Distillers and Chemical Corp. Commercially available adhesives sold under the names ADMER and BYNEL may also be used.

The following Example will serve to illustrate some of the advantages of one embodiment of the bottle of the present invention, but it is understood that this Example is set forth for illustrative purposes and that many other embodiments are within the scope of the present invention.

EXAMPLE I

Freshly processed orange juice was packaged in a group of 4 layer half-gallon bottles (of the type described herein), which had been formed by coextrusion blow-molding. Orange juice from the same lot was packaged in 7 layer half-gallon bottles (of the type described and claimed in copending application Ser. No. 101,730 filed Sep. 28, 1987) which had also been formed by coextrusion blow-molding. The physical parameters of the bottles were as follows:

| | 4 Layer Bottle |
|---|---|
| HDPE | 12.0 mils |
| Regrind | 20.0 mils |
| Adhesive | 1.4 mils |
| EVOH | 1.6 mils |
| | **7 Layer Bottle** |
| HDPE | 10.0 mils |
| Plexar Adhesive | 1.0 mils |
| EVOH | 1.0 mils |
| Plexar Adhesive | 1.0 mils |
| Reground Scrap | 19.0 mils |
| Plexar Adhesive | 1.4 mils |
| EVOH | 1.6 mils |

Thus the overall size and shape of the bottles was the same, the overall thickness of the bottles was about 35 mils for both bottles and the total thickness of EVOH was about 1.6 and about 2.6 mils, respectively.

The filled bottles were placed in a refrigerated warehouse at 32°-34° F. and samples were taken every week thereafter. The samples were analyzed for flavor, brix, acid, ratio, viscosity, oil, color, pulp, pH, Vitamin C and bacti. After 7 months, no significant differences were noted between the orange juice stored in the 4 layer bottles compared to the 7 layer bottles, with an air head space.

In other embodiments, the exterior layers of the bottle (the layers outside of the EVOH layer) may be made from other coextrudible, blow-moldable plastics, such as polypropylene, polystyrene, polyester and nylon, as well as polyethylenes other than high-density polyethylenes. It is necessary that the exterior layers include at least one exterior moisture barrier which functions to insulate the dry side of the EVOH layer from moisture from outside the bottle. It is also necessary that the exterior layer or layers provide sufficient strength and rigidity to the bottle so that it functions as a practical vessel for packaging foods and preferably orange juice. Generally the overall thickness of the bottle, measured at its thinnest point, must be at least 10 mils, although bottles of 15 mils or more may be preferred with respect to their handling characteristics.

The plastic bottle of the present invention may be used to package a wide variety of food products. The plastic bottle of the present invention may be used to package various fruit juices and liquid foods, and other liquid or semi-liquid foods. In its broadest embodiment, the barrier structure may be used to package any non-refrigerated shelf-stable products. For example, the plastic bottle of the present invention may be used to package non-food products, such as flowers, herbicides, tobacco, toothpaste and other materials, wherein it is essential to prevent oxygen from the air from interacting with the packaged product and at the same time prevent oils or other flavor bearing components (or other valuable components of the packaged product) from being absorbed by the package.

The scope of the invention herein shown and described is to be considered only as illustrative. It will be apparent to those skilled in the art that numerous modifications may be made therein without departure from the spirit of the invention and the scope of the appended claims.

I claim:

1. A 4 layer plastic bottle formed by coextrusion blow-molding, said bottle adapted for use as a package for orange juice, said bottle consisting of:

a layer of EVOH, said EVOH having from about 32 to about 44 mol percent of ethylene and having a saponification degree of at least 90% said layer of EVOH being at least 0.5 mils thick, said EVOH layer positioned as the interior-most layer of said bottle to contact said orange juice, said EVOH layer being sufficiently thick to inhibit moisture from inside said bottle from penetrating from the interior surface of said EVOH layer to the exterior portion of said EVOH layer at the temperature selected for the storage of said orange juice;

a layer of high density polyethylene, said polyethylene positioned as the exterior layer of said bottle to contact the ambient atmosphere;

an intermediate layer comprising a mixture of reground scrap from said blow-molding; and an adhesive layer positioned between said EVOH layer and said intermediate layer.

2. A bottle as described in claim 1, wherein said EVOH layer is about 1.5 mils thick.

3. A bottle as described in claim 1, wherein EVOH has a melt index of between 2.9 and about 3.5 as measured by ASTM test D-1238, condition 210/2.16.

* * * * *